United States Patent [19]

Harada et al.

[11] Patent Number: 4,704,190

[45] Date of Patent: Nov. 3, 1987

[54] PULP SLURRY DRAINAGE IMPROVER

[75] Inventors: Susumu Harada, Koriyama; Sakuro Hasegawa, Fujisawa, both of Japan

[73] Assignee: Nitto Boseki Co., Ltd., Gonome Fukushima, Japan

[21] Appl. No.: 731,139

[22] Filed: May 6, 1985

Related U.S. Application Data

[62] Division of Ser. No. 628,832, Jul. 9, 1984, abandoned.

[30] Foreign Application Priority Data

Jul. 11, 1983 [JP] Japan ..... 58-125797

[51] Int. Cl.[4] ..... D21H 3/38

[52] U.S. Cl. ..... 162/168.2; 162/168.6

[58] Field of Search ..... 162/164.6, 168.2, 164.3, 162/168.6

[56] References Cited

U.S. PATENT DOCUMENTS 3,728,214 4/1973 Espy ..... 162/164.6

4,021,484 5/1977 Toda et al. ..... 162/168.2

FOREIGN PATENT DOCUMENTS 118997 9/1981 Japan ..... 162/168.2

*Primary Examiner*—Peter Chin

*Attorney, Agent, or Firm*—Bert J. Lewen; Henry Sternberg

[57] ABSTRACT

Drainage of pulp slurry can be markedly improved without impairing the uniformity of paper quality by adding to the pulp slurry a poly-monoallylamine resin represented by the formula:

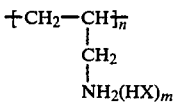

wherein X is Cl, Br, I, $HSO_4$, $HSO_3$, $H_2PO_4$, $H_2PO_3$, HCOO, $CH_3COO$ or $C_2H_5COO$, n is a number of 10 to 100,000, and m is 0 or 1, or a modified resin of the poly-monoallylamine resin.

3 Claims, No Drawings

PULP SLURRY DRAINAGE IMPROVER

This is a divisional of co-pending application Ser. No. 628,832 filed on July 9, 1984, now abandoned.

BACKGROUND OF THE INVENTION

This invention relates to a novel agent for improving drainage of pulp slurry by adding the agent into the slurry.

In the paper making industry, various efforts have been made to increase the paper making rate thereby improving the productivity and lowering the production cost. For the reason, an agent for improving drainage of pulp slurry (pulp slurry drainage improver) has been widely used.

However a relationship between the increase of the paper making rate by use of the agent and the decrease of the formation on the dryer is quite delicate. Therefore a high level of techniques are required to improve the drainage of pulp slurry without impairing the uniformity of paper quality.

As the pulp slurry drainage improver, there has been used a highly polymerized polyethylene imine. However it has drawbacks that (1) in order to achieve desirable drainage, it is required to add it to pulp slurry in a relatively high amount and (2) it is rather toxic.

SUMMARY OF THE INVENTION

Extensive studies by the present inventors have revealed that the water drainage of pulp slurry can be amazingly improved without impairing the uniformity of paper quality by adding a specific poly-monoallylamine resin only in a small ratio into the pulp slurry, and the present invention was achieved on the basis of such finding.

Thus, the present invention provides a pulp slurry drainage improver comprising a poly-monoallylamine resin represented by the following formula:

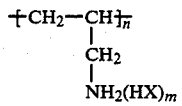

wherein X is Cl, Br, I, $HSO_4$, $HSO_3$, $H_2PO_4$, $H_2PO_3$, HCOO, $CH_3COO$ or $C_2H_5COO$, n is a number of 10 to 100,000, and m is 0 or 1, or a modified resin of the polymonoallylamine resin.

DETAILED DESCRIPTION OF THE INVENTION

The poly-monoallylamine resin or their modified resins usable in the present invention include homopolymers (A) of inorganic acid salts of monoallylamine obtained by polymerizing inorganic acid salts of monoallylamine, homopolymers (A') of monoallylamine obtained by removing inorganic acids from acid polymers (A), and homopolymers (A'') of organic acid salts of monoallylamine obtained by neutralizing said polymers (A') with an organic acid such as formic acid, acetic acid, propionic acid, p-toluenesulfonic acid or the like; copolymers (B) obtained by copolymerizing inorganic acid salts of monoallylamine with a small quantity of polymerizable monomers (such as inorganic acid salts of triallylamine) containing two or more double bonds in the molecule, said copolymers (B) being soluble in water and identical with said polymers (A) in the properties other than those relating to molecular weight; and modified polymers (C) obtained by reacting the compounds (such as epichlorohydrin) containing two or more groups reactable with amino group in the molecule with said polymers (A), polymers (A'), polymers (A'') or copolymers (B), said modified polymers (C) being soluble in water and identical with said polymers (A), (A'), (A'') or (B) in the properties other than those relating to molecular weight.

The homopolymers (A) of inorganic acid salts of monoallylamine used in this invention can be prepared, for example, by polymerizing an inorganic acid salt of monoallylamine in a polar solvent in the presence of a radical initiator containing in its molecule an azo group and a group having a cationic nitrogen atom or atoms. The preparation examples are shown in the Referential Examples given later, but the details are described in the specification of Japanese Patent Applicaton No. 54988/83 (Japanese Patent Kokai (Laid-Open) No. 201811/83) filed by the present applicant.

These poly-monoallylamine resins and their modified resins are found to produce their effect in all types of fiber materials comprising cellulose as their base, but said resins can produce an especially significant practical effect when they are utilized in the field of waste paper (old newspaper) and unbleached kraft pulp. The amount of the resin required to be added for producing the desired effect is usually in the range of 0.005 to 1.0% by weight, preferably 0.01 to 0.5% by weight, based on the fiber material content of the pulp.

In practical use of the poly-monoallylamine resin or its modified resin of this invention, it may be treated in the same way as in the case of any ordinary drainage improving agent. The following method is typical example.

An aqueous solution of the resin stored in a tank is supplied into a mixer by a constant delivery pump and the resin solution is diluted into a low concentration. Such dilution is necessary for allowing uniform mixing of both fiber material and resin in a short contact time. Then, the resin solution is passed through a rotar-meter so that a required amount of the resin solution is added to the pulp slurry. The spot at which the resin solution is to be added to the pulp slurry should be decided by considering the contact time that will allow the pulp slurry to be carried on the wire at a time when the freeness has been maximized, but usually it is suggested to add the resin solution at a point just before the screen.

The preparation method of the poly-monoallylamine resin and its modified resin used in this invention will be illustrated below as referential examples.

REFERENTIAL EXAMPLE 1

Shown in this example is a method for producing poly-monoallylamine hydrochloride and poly-monoallylamine.

570 g (10 mol) of monoallylamine (a product by shell Chemicals of U.S.; boiling point: 52.5°–53° C.) is added dropwise into 1.1 kg of concentrated hydrochloric acid (35% by weight) under cooling and stirring at 5°–10° C. After said addition is ended, water and excessive hydrogen chloride are distilled off by using a rotary evaporator under a reduced pressure of 20 Torr. at 60° C. to obtain white crystals. These crystals are dried over drying silica gel under a reduced pressure of 5 Torr, at 80° C. to obtain monoallylamine hydrochloride (containing about 5% of water).

590 g (6 mol) of said monoallylamine hydrochloride and 210 g of distilled water are put into a 2-liter round flask equipped with a stirrer, a thermometer, a reflux condenser and a nitrogen gas inlet tube, and they are stirred and dissolved. Then 7 g of 2,2'-bis-(N-phenylamidinyl)-2,2'-azopropane-dihydrochloride, an azo-type initiator containing cationic groups, dissolved in 10 ml of distilled water, is added. The mixture is polymerized under stirring at 48°–52° C. while passing nitrogen gas therethrough. 10 hours thereafter, 7 g of said initiator dissolved in 10 ml of distilled water is further added to keep on with the polymerization. Heat generation ceases 5 hours thereafter, so stirring is stopped and standing polymerization is continued at 50° C. ±1° C. for additional 50 hours. There is resultantly obtained a colorless and transparent viscous solution (an aqueous solution of polymonoallylamine hydrochloride, hereinafter referred to as resin A-1 solution). Although this solution can be immediately used as a drainage improving resin solution in this invention, the solid polymer may be recovered from the solution by the following operation: 415 g of said resin A-1 solution is added into approximately 5 liters of methanol to form a white precipitate of the polymer, and this precipitate, without dried, is finely broken up in methanol and extracted with methanol for 15 hours by using a Soxhlet extractor, removing the unpolymerized monoallylamine hydrochloride. The precipitate is dried under reduced pressure at 50° C. to obtain 265 g of the polymer (yield: 90%). This polymer was identified as polymonoallylamine hydrochloride (hereinafter referred to as resin A-1) by elementary analysis, IR absorption spectral analysis and NMR spectral analysis. The intrinsic viscosity [$\eta$] of resin A-1 determined in a 1/1ON NaCl solution was 0.43 (g/100 ml).

Then an aqueous solution formed by dissolving 40 g of sodium hydroxide in 100 g of distilled water is added to 139 g of said resin A-1 solution under cooling. The resulting solution has a smell of amine, so the solution is lightly sucked off under reduced pressure to obtain a NaCl solution of poly-monoallylamine (hereinafter referred to as resin A-2 solution; actual resin concentration: about 18%). This solution can be directly used as a drainage improving resin solution in this invention, but the polymer (poly-monoallylamine) may be recovered from the solution by the following operation: 30 g of said resin A-1 is dissolved in 270 g of distilled water and passed through a strongly basic ion exchange resin (Amberlite IRA-402) to remove hydrochloric acid, and the filtrate is concentrated and freeze-dried, whereby 16.5 g of white poly-monoallylamine (hereinafter referred to as resin A-2) can be obtained.

REFERENTIAL EXAMPLE 2

This example shows the method of producing slightly bridged poly-monoallylamine hydrochloride by copolymerizing with a small quantity of triallylamine hydrochloride.

The same polymerization process as in Referential Example 1 is carried out by adding 10.5 g (6/100 mol) of triallylamine hydrochloride in addition to 590 g (6 mol) of monoallylamine hydrochloride. The amounts of water and catalyst are the same as in Referential Example 1. The polymerization gives a colorless and transparent viscous solution (hereinafter referred to as resin B-1 solution). This solution, in the form as it is, can be used as a drainage improving resin solution in this invention, but the polymer may be recovered in the same way as in Referential Example 1. That is, 210 g of resin B-1 solution is added to about 3 liters of methanol to precipitate resin B-1 and the latter is treated according to the method of Referential Example 1 to obtain 105 g of the polymer (resin B-1) (yield: about 75%). The values of elementary analysis, IR absorption spectrum and NMR spectrum of this resin B-1 were substantially equal to those of resin A-1.

Intrinsic viscosity [$\eta$] of resin B-1 determined in a 1/1ON NaCl solution was 0.96.

REFERENTIAL EXAMPLE 3

This example is the method of producing slightly bridged poly-monoallyamine by treating polymonoallylamine with epichlorohydrin.

0.1 g of epichlorohydrin is added to 100 g of a NaCl solution of polyallylamine (resin A-2 solution) (actual resin concentration: 18%) whose production method was shown in Referential Example 1, and the mixture is reacted under stirring at 30 ±2° C. for 2 hours, whereby the viscosity of the system increases to form a viscous solution. This solution (hereinafter referred to as resin C-1 solution) can be used immediately as a drainage improving resin solution in this invention.

Hereinafter, the present invention will be described in detail by way of the embodiments thereof, but it is to be understood that the present invention is not limited by these embodiments.

EXAMPLE 1

This Example shows the method and results of a drainage improvement test conducted on a pulp slurry prepared from wastepaper (old newspaper).

500 g of wastepaper (old newspaper) was immersed in water, washed in the usual way and the macerated by using a 10-liter test beater under the following conditions:

Liquor ratio: 1:10

Amount of sodium hydroxide added: 1% (in ratio to wastepaper)

Temperature: 50° C.

Time: 1 hour

The freeness C.S.F. (Canadian Standard Freeness) of the obtained slurry was 370 ml.

The pulp concentration at the time of addition of drainage imrpoving agent was adjusted to 2.5 g/l.

The following five types of poly-monoallylamine resin and, as a comparative sample, a polyethyleneimine (polymerization degree 1000, molecular weight 42,000) were used as the drainage improving agent for the test.

1. Resin A-1 solution (Referential Example 1), actual resin concentration: 64%
2. Resin A-1 (Referential Example 1), actual resin concentration: 95%
3. Resin A-2 solution (Referential Example 1), actual resin concentration: 18%
4. Resin B-1 solution (Referential Example 2), actual resin concentration: 50%
5. Resin C-1 solution (Referential Example 3), actual resin concentration: 18%
6. Polyethyleneimine (Comparative Example), actual resin concentration: 33%

Each resin was dissolved in or diluted with water to form an aqueous solution with an actual resin concentration of 2.5 g/l.

A measured amount of each pulp slurry was put into a 5-liter plastic container and a predetermined amount of each improving agent was added thereto under stirring. After allowing contact of the agent with the pulp for a given period of time, the freeness of the pulp slurry was measured in the usual way by using a Canadian standard freeness tester. The results are summarized in Table 1.

TABLE 1

| Drainage improving agent | Amount of agent added (in % to pulp) | pH at the time of addition | Freeness (C.S.F. ml) |
|---|---|---|---|
| No agent added | — | 7.6 | 340 |
| 1. Resin A-1 solution | 0.03 | 7.4 | 445 |
| | 0.06 | 7.4 | 465 |
| | 0.09 | 7.4 | 465 |
| 2. Resin A-1 | 0.03 | 7.5 | 462 |
| | 0.06 | 7.4 | 482 |
| | 0.09 | 7.4 | 448 |
| 3. Resin A-2 solution | 0.03 | 7.6 | 530 |
| | 0.06 | 7.6 | 482 |
| | 0.09 | 7.6 | 465 |
| 4. Resin B-1 solution | 0.03 | 7.4 | 536 |
| | 0.06 | 7.4 | 520 |
| | 0.09 | 7.4 | 485 |
| 5. Resin C-1 solution | 0.03 | 7.6 | 542 |
| | 0.06 | 7.6 | 502 |
| | 0.09 | 7.6 | 483 |
| 6. Polyethylene imine | 0.03 | 7.4 | 400 |
| | 0.06 | 7.6 | 443 |
| | 0.09 | 7.6 | 503 |

Note:
Amount of agent added (in % to pulp) was calculated in terms of pure resin matter.

EXAMPLE 2

The same test as in Example 1 was conducted by using unbleached draft pulp. The freeness of the pulp slurry used was 30 ml in CSF. The results are shown in Table 2.

TABLE 2

| Drainage improving agent | Amount of agent added (in % to pulp) | pH of the time of addition | Freeness (C.S.F. ml) |
|---|---|---|---|
| No agent added | — | 7.1 | 300 |
| 1. Resin A-1 solution | 0.03 | 7.4 | 383 |
| | 0.06 | 7.4 | 392 |
| | 0.09 | 7.5 | 390 |
| 2. Resin A-1 | 0.03 | 7.3 | 420 |
| | 0.06 | 7.4 | 443 |
| | 0.09 | 7.4 | 420 |
| 3. Resin A-2 solution | 0.03 | 7.5 | 460 |
| | 0.06 | 7.4 | 440 |
| | 0.09 | 7.5 | 425 |

TABLE 2-continued

| Drainage improving agent | Amount of agent added (in % to pulp) | pH of the time of addition | Freeness (C.S.F. ml) |
|---|---|---|---|
| 4. Resin B-1 solution | 0.03 | 7.5 | 477 |
| | 0.06 | 7.4 | 454 |
| | 0.09 | 7.4 | 426 |
| 5. Resin C-1 solution | 0.03 | 7.5 | 486 |
| | 0.06 | 7.5 | 464 |
| | 0.09 | 7.4 | 472 |
| 6. Polyethylene imine | 0.03 | 7.4 | 364 |
| | 0.06 | 7.5 | 370 |
| | 0.09 | 7.6 | 426 |

Note:
Amount of agent added (in % to pulp) was calculated in terms of pure resin matter.

As apparent from the above-shown test results, the pulp slurry drainage improver of this invention shows an excellent water-draining performance at a small rate of addition in comparison with the conventional polyethyleneimine.

What is claimed is:

1. A pulp slurry drainage improving method characterized by adding to pulp slurry a polymeric material which is selected from the group consisting of polymonoallylamine homopolymers (A) represented by the formula:

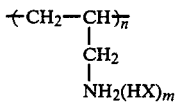

wherein X is Cl, Br, I, $HSO_4$, $HSO_3$, $H_2PO_4$, $H_2PO_3$, HCOO, $CH_3COO$ or $C_2H_5COO$, n is a number of 10 to 100,000, and m is 0 or 1 copolymers (B) obtained by copolymerizing 6 moles of an inorganic acid salts of monoallylamine with no more than about 6/100 moles of an inorganic salts of triallylamine; and modified polymers (C) obtained by reacting no more than about 0.1 part by weight of epichlorohydrin with 18 parts by weight of said polymers (A), or (B), said modified polymers (C) being soluble in water.

2. A pulp slurry drainage improving method according to claim 1, wherein the amount of the polymeric material is 0.005 to 1.0% by weight based on the content of pulp fiber material.

3. A pulp slurry drainage improving method according to claim 1, wherein the amount of the polymeric material is 0.01 to 0.5% by weight based on the content of pulp fiber material.

* * * * *